US008403331B2

(12) United States Patent
Mahoney et al.

(10) Patent No.: US 8,403,331 B2
(45) Date of Patent: Mar. 26, 2013

(54) METHOD AND APPARATUS FOR INJECTING PACKING INTO STUFFING BOXES FOR RECIPROCATING RODS

(75) Inventors: Mark William Mahoney, Granbury, TX (US); Ian Douglas Rimmer, Woodvale (AU); Benny J. Williams, Godley, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 1945 days.

(21) Appl. No.: 11/137,285

(22) Filed: May 25, 2005

(65) Prior Publication Data

US 2005/0230106 A1 Oct. 20, 2005

Related U.S. Application Data

(63) Continuation of application No. 10/403,323, filed on Mar. 31, 2003, now abandoned.

(60) Provisional application No. 60/369,499, filed on Apr. 2, 2002, provisional application No. 60/403,148, filed on Aug. 13, 2002.

(51) Int. Cl.
*F16J 15/16* (2006.01)

(52) U.S. Cl. ..... 277/308

(58) Field of Classification Search ..... 277/329, 277/338, 542, 534, 308, 317, 512; 166/84.1, 166/84.4

See application file for complete search history.

(56) References Cited

U.S. PATENT DOCUMENTS

| | | | | | |
|---|---|---|---|---|---|
| 779,480 | A | * | 1/1905 | Jhonston | 277/500 |
| 884,318 | A | | 4/1908 | Dailey et al. | |
| 894,739 | A | * | 7/1908 | Jhonston | 277/542 |
| 1,318,352 | A | | 10/1919 | Cameron et al. | |
| 1,324,775 | A | * | 12/1919 | Anathor-Henriksen | 384/16 |
| 1,387,301 | A | | 8/1921 | Osborne | |
| 1,884,903 | A | | 10/1932 | Squires | |
| 1,911,670 | A | | 5/1933 | Black | |
| 1,947,198 | A | | 2/1934 | Goble | |
| 1,991,714 | A | | 2/1935 | Wheeler | |
| 2,235,289 | A | | 3/1941 | Dunn et al. | |
| 2,267,183 | A | | 12/1941 | Williams | |
| 2,307,346 | A | | 1/1943 | Herbert | |
| 2,459,472 | A | | 1/1949 | Tremolada | |
| 2,486,939 | A | | 11/1949 | Freund | |
| 2,504,936 | A | | 4/1950 | Payne | |
| 2,628,112 | A | | 2/1953 | Hebard | |
| 2,731,282 | A | * | 1/1956 | McManus et. al. | 277/513 |
| 3,084,946 | A | | 4/1963 | Sharp | |
| 3,120,394 | A | | 2/1964 | Gould | |
| 3,199,876 | A | * | 8/1965 | Magos et al. | 277/500 |
| 3,626,770 | A | | 12/1971 | Lindberg et al. | |
| 3,719,366 | A | | 3/1973 | Pippert | |
| 3,876,213 | A | | 4/1975 | Miliczky et al. | |
| 3,887,196 | A | | 6/1975 | Renfrow | |
| 3,948,588 | A | | 4/1976 | Curington et al. | |
| 4,150,727 | A | | 4/1979 | Shepherd | |

(Continued)

OTHER PUBLICATIONS

Merriam-Webster's Collegiate Dictionary, Tenth Edition, p. 705. Meltable meaning capable of being extended or shaped by beating with a hammer or by pressure of rollers.*

(Continued)

*Primary Examiner* — Vishal Patel
(74) *Attorney, Agent, or Firm* — Geoffrey A. Mantooth

(57) ABSTRACT

A stuffing box for a polished rod used with a downhole pump uses injectable packing to provide a seal around the polished rod. The stuffing box has a chamber for receiving the packing. The chamber has an opening to allow the addition of packing to the chamber. The packing is maintained in a compacted condition by either injecting additional packing through the opening or adjusting the volume of the chamber.

16 Claims, 7 Drawing Sheets

U.S. PATENT DOCUMENTS

| | | | |
|---|---|---|---|
| 4,162,078 | A | 7/1979 | Cox |
| 4,177,998 | A | 12/1979 | Laitkep et al. |
| 4,328,974 | A | 5/1982 | White et al. |
| 4,364,542 | A | 12/1982 | Meyer |
| 4,384,726 | A | 5/1983 | Meyer |
| 4,430,892 | A | 2/1984 | Owings |
| 4,449,596 | A | 5/1984 | Boyadjieff |
| 4,560,176 | A | 12/1985 | Hoff |
| 5,112,140 | A | 5/1992 | Cherny et al. |
| 5,135,240 | A | 8/1992 | Dodson |
| 5,209,495 | A | 5/1993 | Palmour |
| 5,284,084 | A | 2/1994 | Pippert et al. |
| 5,343,944 | A | 9/1994 | Bassinger |
| 5,480,163 | A | 1/1996 | Miser et al. |
| 5,549,156 | A | 8/1996 | Borden |
| 5,577,737 | A | 11/1996 | Lacy |
| 5,590,966 | A | 1/1997 | Chemey et al. |
| 5,771,968 | A | 6/1998 | Danciger et al. |
| 5,823,541 | A | 10/1998 | Dietle et al. |
| 5,960,700 | A | 10/1999 | Staggs et al. |
| 6,007,105 | A | 12/1999 | Dietle et al. |
| 6,302,401 | B1 | 10/2001 | Palmour |
| 6,412,783 | B1 | 7/2002 | Finnestad |
| 2003/0214100 | A1 | 11/2003 | Pippert |
| 2004/0035574 | A1 | 2/2004 | Pippert |

OTHER PUBLICATIONS

Merriam-Webster's Collegiate Dictionary, Tenth Edition, p. 602. Injectable meaning capable to inject. Inject meaning introduce into something forcefully.*

Utex Industries, Inc. brochure, UPak Injectable Pump and Valve Sealant, Product No. 8888-00-0047-00, May 2001, 6 pages.

Letter dated Sep. 1, 1999 from Utex Industries, Inc. to Harbison-Fischer Mfg. Co. 1 page, with attachments ( 7 pages).

PCT International Application Publication No. WO 00/53959, Sep. 14, 2000, 13 pages.

* cited by examiner

METHOD AND APPARATUS FOR INJECTING PACKING INTO STUFFING BOXES FOR RECIPROCATING RODS

This application is a continuation of U.S. application Ser. No. 10/403,323, filed Mar. 31, 2003, now abandoned which application was a continuation-in-part of U.S. application Ser. No. 60/369,499, filed Apr. 2, 2002, and a continuation-in-part of U.S. application Ser. No. 60/403,148, filed Aug. 13, 2002.

FIELD OF THE INVENTION

The present invention relates to stuffing boxes that are used to provide a seal around a reciprocating rod or shaft, such as might be found on a rod pumped oil or gas well.

BACKGROUND OF THE INVENTION

Downhole, or subsurface, pumps are commonly used to lift fluids, such as crude oil, to the surface. The pump is located in the well below the level of the oil. A string of sucker rods extends from the pump up to the surface, to a pump jack device, or beam pump unit. The pump jack is connected to the sucker rod string by way of a polished rod that reciprocates in a stuffing box. The stuffing box provides a seal around the polished rod, allowing the flow of downhole fluids to be directed to an outlet line.

Stuffing boxes for wellhead polished rods typically use friction type seals constructed from a rubber-based material. Common friction type seals used in wellhead stuffing boxes are conical seals, such as shown in U.S. Pat. Nos. 3,084,946 and 4,560,176 and pressure seals. The seals, which are pressurized either by a gland or by well bore pressure, wear and must be periodically replaced.

Replacing conventional seals is fraught with problems; well operators do not like to do so because of the time involved and other reasons. For example, the well must be shut down to stop the movement of the polished rod. Furthermore, before the seals are removed, they must be isolated from the pressure inside of the well. This is accomplished by closing a packer or a blowout preventer located below the stuffing box. Occasionally, the ability of the packer to maintain a seal is compromised by factors such as age or even wear, as the operator may have relied on the packer to compensate for leaking stuffing box seals. If this happens, the packer seal could fail when the operator is removing the stuffing box seals, resulting in a dangerous pressure release of hydrocarbons or gas.

Furthermore, the seals are out of sight in the stuffing box. The operator has no adequate way to determine if the seals are in satisfactory condition, other than to stop the pump jack and open the stuffing box to visually inspect the seals, or to wait for crude oil to leak from the stuffing box. As U.S. Pat. Nos. 5,209,495 and 6,302,401 teach, the leakage of crude oil from the stuffing box is environmentally unsound.

Stuffing boxes can be provided with an injectable packing, such as is taught by Cox, U.S. Pat. No. 4,162,078. Such injectable packing is useful for many pumps, such as the multiplex-type pump, where the reciprocating rod or piston moved along a fixed axis. In a well bore pump however, the axis of movement of the polished rod is itself subject to movement. Any such movement of the polished rod axis causes gaps and shifts in the packing material, resulting in lost seal integrity.

SUMMARY OF THE INVENTION

It is an object of the present invention to provide a method and apparatus for providing a wellhead stuffing box with a seal that can be replaced without stopping the pump.

It is another object of the present invention to provide a method and apparatus that automatically provides replacement packing material to a stuffing box.

It is another object of the present invention to provide a method and apparatus that provides a visual indication of the status or quantity of packing material.

It is another object of the present invention to provide a method and apparatus that negates exposing an operator to a potentially dangerous pressure release when resupplying seal material to a stuffing box.

The present invention provides an apparatus for use on wellhead equipment having a reciprocating polished rod. The apparatus comprises a stuffing box having a wall defining a stuffing chamber with two ends. The ends have openings for receiving the polished rod and the polished rod reciprocates relative to the stuffing box wall. At least one opening through the wall communicates with the stuffing chamber. A reservoir is structured and arranged to contain injectable packing material. The reservoir communicates with the opening to the stuffing chamber. A pressure source applies pressure to the packing material in the reservoir so as to inject the packing material from the reservoir into the stuffing chamber.

With the present invention, the sealing material is automatically replenished during the operation of the reciprocating polished rod. Therefore, the polished rod need not be stopped for maintenance of the stuffing box. Furthermore, as the stuffing box provides a seal around the polished rod, pressures on the wellhead side of the polished rod need not be vented or sealed off in order to replenish the sealing or packing material. This is an important safety advantage to protect the operators.

In accordance with another aspect of the present invention, the at least one opening through the wall communicating with the stuffing chamber further comprises a plurality of openings circumferentially spaced about the stuffing box chamber. A collar is coupled to the stuffing box wall, with the collar having a circumferential passage therein. The circumferential passage communicates with the openings through the stuffing box wall. The reservoir communicates with the collar passage.

In accordance with another aspect of the present invention, the reservoir is mounted to the collar.

In accordance with still another aspect of the present invention, the collar rotates about the circumference of the stuffing box. Thus, the reservoir can be pivoted or rotated about the stuffing box in order to avoid any obstacles.

In accordance with still another aspect of the present invention, the reservoir communicates with the stuffing box chamber opening by a passage, which passage has a check valve therein to prevent packing from flowing from the stuffing box chamber to the reservoir.

In accordance with another aspect of the present invention, a piston is located inside of the reservoir. The pressure source acts on the piston.

In accordance with another aspect of the present invention, the pressure source comprises fluid acting on the piston. In the alternative, the pressure source comprises a spring acting on the piston.

In accordance with still another aspect of the present invention, a shaft is coupled to the piston, which shaft extends out of the reservoir and provides a visual indication of the amount of packing in the reservoir.

In accordance with still another aspect of the present invention, the shaft has a fill passage therethrough that communicates with the reservoir.

In accordance with still another aspect of the present invention, the apparatus further comprises an indicator of the amount of packing material contained in the reservoir.

In accordance with still another aspect of the present invention, the stuffing box is mounted to the wellhead by bearings, wherein the stuffing box maintains alignment with an axis of reciprocation of the polished rod. Thus, the present invention allows the stuffing box to align itself with the reciprocation axis of the polished rod. This reduces or minimizes wear on stuffing box components that contain the packing within the stuffing box, thereby ensuring that the packing will not extrude or leak out of the stuffing box due to misalignment problems.

The present invention also provides a method of sealing a stuffing box on wellhead equipment having a reciprocating polished rod. A supply of packing is provided. A connection is provided between the supply of packing to the stuffing box. The supply of packing is pressurized and injected into the stuffing box.

In accordance with one aspect of the present invention, the step of injecting the packing into the stuffing box occurs while the polished rod reciprocates.

In accordance with another aspect of the present invention, the polished rod is reciprocated in and out of wellhead fluids.

In accordance with another aspect of the present invention, the step of injecting the packing into the stuffing box further comprises injecting the packing into circumferentially spaced locations about the polished rod.

In accordance with still another aspect of the present invention, an indication of the supply of packing in the stuffing box is provided.

In accordance with still another aspect of the present invention, the stuffing box is allowed to move so that the stuffing box maintains alignment with an axis of reciprocation of the polished rod.

The present invention provides a stuffing box for use with a downhole pump, a reciprocating polished rod and sucker rods connecting the polished rod to the pump. The stuffing box comprises a housing that forms a closed chamber therein. The chamber has first and second ends, with each of the first and second ends having an opening for receiving the polished rod. One of the first or second ends is structured and arranged to couple to wellhead equipment. A valved port in the housing allows selective communication between the exterior of the housing and the chamber. Injectable packing is located in the chamber.

In accordance with one aspect of the present invention, the stuffing box further comprises a pressure application member in contact with a portion of the injectable packing and applying pressure to the packing in the chamber.

In accordance with another aspect of the present invention, the pressure application member is located inside of the housing.

In accordance with still another aspect of the present invention, the pressure application member forms a bushing in the chamber.

In accordance with still another aspect of the present invention, the pressure application member is structured and arranged to contact the fluid pumped uphole by the downhole pump.

In accordance with another aspect of the present invention, the pressure application member is exposed to a pressure source.

In accordance with still another aspect of the present invention, the pressure application member is located exteriorly of the housing.

In accordance with still another aspect of the present invention, the stuffing box further comprises an indicator of the amount of packing located in the chamber.

The present invention also provides a stuffing box for use with a polished rod of a downhole pump that comprises a housing having a chamber therein. The chamber is structured and arranged for receiving the polished rod and allows the polished rod to reciprocate therein. The chamber has two ends. A first bushing is located at one end of the chamber and a second bushing is located at the other end of the chamber. The second bushing is movable with respect to the first bushing. A valved port is in the housing and allows selective communication between an exterior of the housing and the chamber. Malleable packing is located in the chamber between the first and second bushings.

In accordance with one aspect of the present invention, the second bushing has first and second ends with the first end located in contact with the packing and the second end located out of contact with the packing. The second bushing first end has a first surface area and the second bushing second end has a second surface area. The first surface area is different than the second surface area.

In accordance with another aspect of the present invention, the first surface area is smaller than the second surface area.

In accordance with still another aspect of the present invention, the second end is structured and arranged to be in contact with the fluid produced by the pump.

In accordance with still another aspect of the present invention, an indicator is coupled to the second bushing, with at least a portion of the indicator located exteriorly of the housing in selected positions of the second bushing in the chamber.

The present invention also provides a method of providing a seal around a polished rod for a downhole pump. A closed chamber is provided having first and second openings therethrough for receiving the polished rod. Packing is injected into the chamber.

In accordance with one aspect of the present invention, the step of injecting packing into the chamber occurs while the polished rod is reciprocating.

The present invention also provides a method of providing a seal around a polished rod for a downhole pump wherein a closed chamber is provided. The chamber has first and second openings therethrough for receiving the polished rod. The chamber is filled with a malleable packing, and the packing is compressed.

In accordance with one aspect of the present invention, the packing is compressed by diminishing a volume of the chamber.

In accordance with another aspect of the present invention, the volume of the chamber is diminished by pressurizing the chamber with fluid produced by the pump.

The present invention also provides a method of providing a seal around a polished rod for a downhole pump. A closed chamber is provided having first and second openings therethrough for receiving the polished rod. Packing is inserted into the chamber. The amount of packing is indicated during the reciprocation of the polished rod.

The present invention also provides a stuffing box for use with a downhole pump, a reciprocating polished rod and sucker rods connecting the polished rod to the pump. The stuffing box comprises a chamber that is structured and arranged to receive the reciprocating polished rod. The chamber comprises an annulus around the polished rod when the polished rod is received in the chamber. Malleable packing is located in the annulus. The annulus comprises a first member that exerts pressure on the malleable packing, the annulus changes volume according to the quantity of packing located therein. An indicator of the quantity of packing located in the annulus is provided, with the indicator being visible from an exterior of the stuffing box.

In accordance with one aspect of the present invention, the indicator comprises a second member coupled to the first member.

In accordance with another aspect of the present invention, the annulus is sealed and the second member is coupled to the first member outside of the sealed annulus.

The present invention also provides an apparatus for use in a well having a downhole pump, a reciprocating polished rod and sucker rods connecting the polished rod to the pump. The apparatus comprises a stuffing box, which in turn comprises a housing having a chamber therein. The chamber is structured and arranged to receive the reciprocating polished rod and has an annulus around the polished rod when the polished rod is received within the chamber. A piston is located at one end of the chamber, with the piston being annular so as to receive the polished rod. One end of the piston is located within the chamber annulus, with another end of the piston being structured and arranged to be exposed to well fluids. Malleable packing is located in the chamber annulus and in contact with the piston, the packing being pressurized by the piston.

In accordance with one aspect of the present invention, the housing further comprises an inlet port that communicates with the chamber so that the packing can be added to the chamber.

In accordance with still another aspect of the present invention, there is an indicator member coupled to the piston and visible from an exterior of the housing.

In accordance with another aspect of the present invention, the other end of the piston that is exposed to well fluids is sized according to the pressure of the well fluids.

In accordance with another aspect of the present invention, the apparatus further comprises upper and lower sacrificial bushings for receiving the polished rod and a bearing arrangement to maintain the alignment of the polished rod with the stuffing box. The bearing arrangement is coupled to the stuffing box.

DESCRIPTION OF THE PREFERRED EMBODIMENTS

Figure 1:
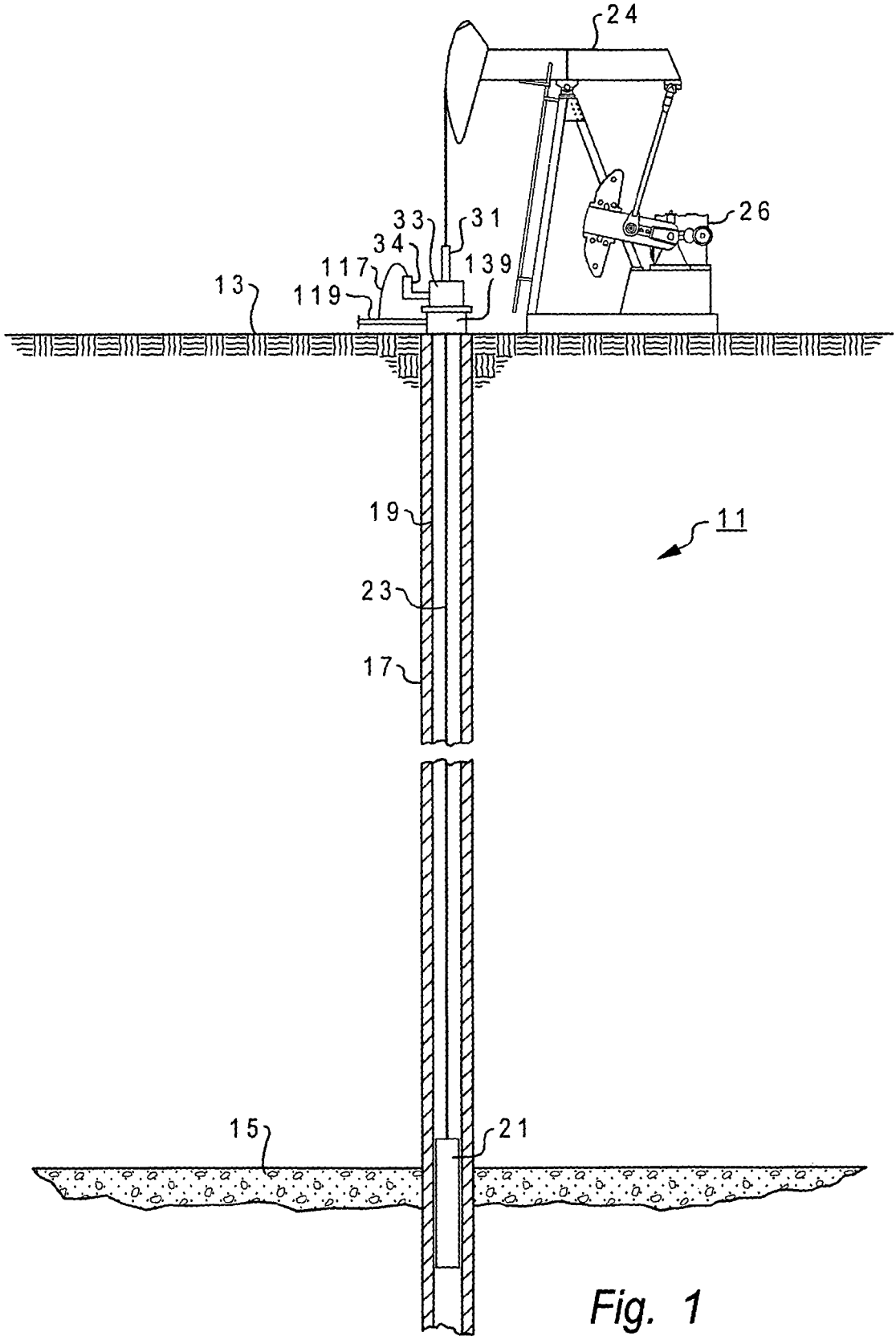
FIG. 1 is a schematic diagram of a well, shown with pumping equipment.

In FIG. 1, there is shown a schematic diagram of a producing oil well 11. The well has a borehole that extends from the surface 13 into the earth, through an oil-bearing formation 15. The borehole has been completed and therefore has casing 17 which is perforated at the formation 15. A packer or other device (not shown) optionally isolates the formation 15 from the rest of the borehole. Tubing 19 extends inside of the casing from the formation 15 to the surface 13.

A subsurface pump 21 is located in the tubing 19 at or near the formation 15. A string of sucker rods 23 extends from the pump 21 up inside of the tubing 19 to a polished rod 31. The polished rod 31 is connected, by way of a cable, to a pump jack unit 24. The pump jack unit 24 reciprocates up and down due to a prime mover 26, such as an electric motor, a gasoline or diesel engine, or a gas engine.

The polished rod 31 reciprocates up and down inside of a stuffing box 33, which stuffing box maintains a seal around the polished rod.

The present invention continually applies sealing or packing material to the stuffing box 33 during the operation of the pump. A reservoir 34 provides a reserve quantity of packing material. The reservoir 34 can be located exteriorly of the stuffing box housing, as shown, or interiorly. The supply of packing material can be replenished while the pump is in operation, and without the necessity of stopping the pump.

The pump jack unit 24 may become misaligned with the well 11. Such misalignment may be caused, for example, by shifting or movement of the earth surface 13. The pump jack unit 24 is not directly coupled to the well head 139. Consequently, the polished rod 31, which has one end coupled to the pump jack unit 24, and descends through the stuffing box into the well, can become misaligned within the well. In such an event, the polished rod is not parallel to the longitudinal axis of the well casing.

Figure 2:
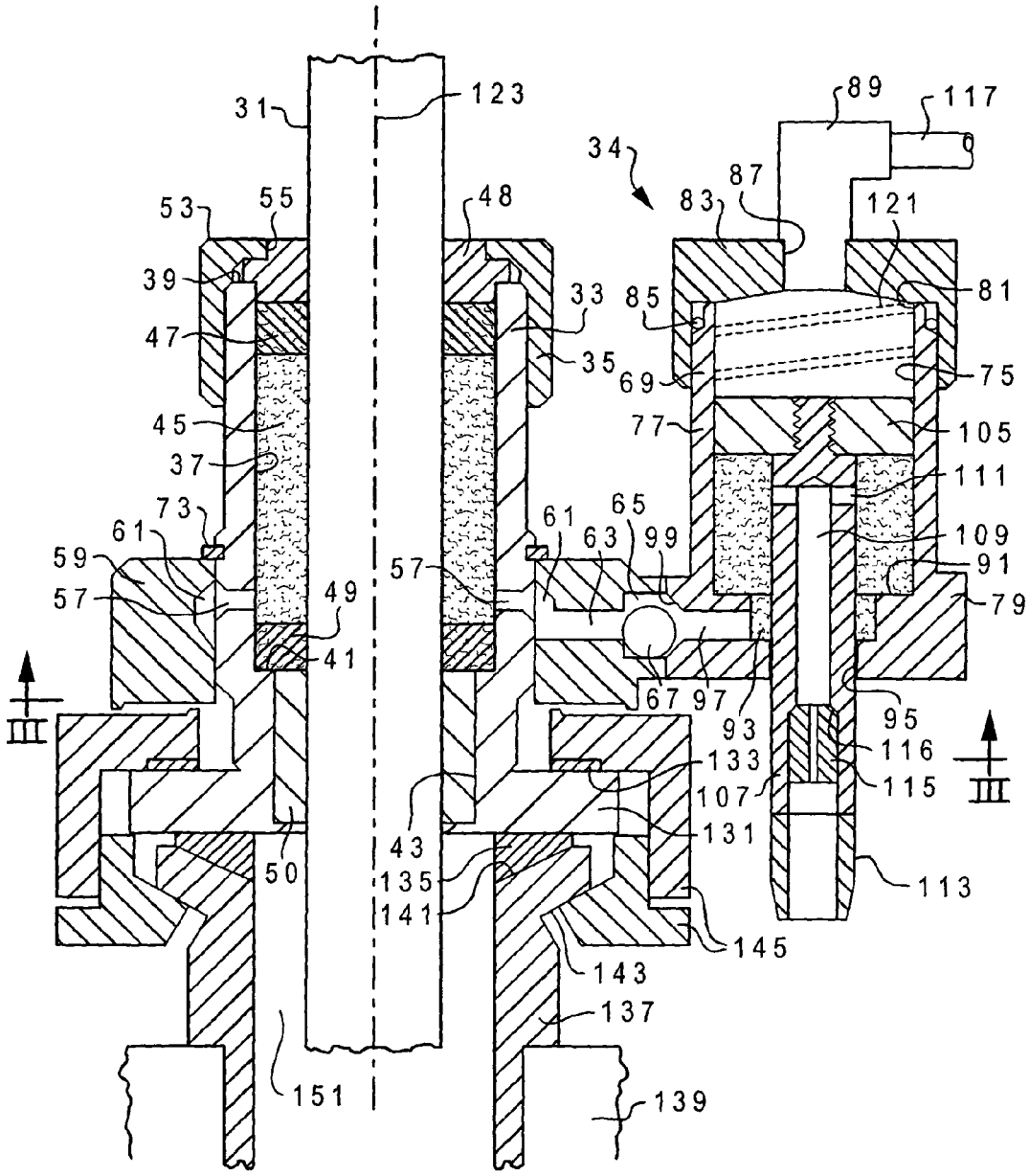
FIG. 2 is a cross-sectional view of the stuffing box of the present invention, in accordance with a preferred embodiment.

In the description that follows, "upper" and "lower" will be used to describe various components; these terms are used with reference to the orientation shown in FIG. 2.

FIG. 2 shows a cross-sectional view of the apparatus of the present invention. The stuffing box 33 has a cylindrical wall 35 forming a cylindrical chamber 37. The chamber 37 is open at one end 39 and has an inwardly extending shoulder 41 at the opposite end. The shoulder surrounds an opening 43.

The polished rod 31 extends through the chamber 37 and the opening 43. The polished rod reciprocates relative to the chamber 37.

An injectable packing 45 is located in the annular region in the chamber 37 around the polished rod 31. The packing 45 is contained inside of the chamber by upper and lower anti-extrusion rings 47, 49. The lower anti-extrusion ring 49 bears on the shoulder 41, while the upper anti-extrusion ring 47 bears on the packing 45 in the chamber 37. The anti-extrusion rings 47, 49 effectively close off the upper and lower ends of the annular space around the polished rod to the packing. Upper and lower bronze bushings 48, 50 are provided to contain the anti-extrusion rings 47, 49.

The upper end 39 of the chamber is closed by a cap 53 that threads onto the wall 35. The cap 53 has an opening 55 therethrough for the polished rod 31. The cap 53 prevents upward movement of the upper bushing 48.

The injectable packing 45 is believed to be a mixture of plastic pieces, or synthetic fibers, and lubricants, such as is described in Cox, U.S. Pat. No. 4,162,078, the disclosure of which is incorporated herein by reference. The packing is malleable and in general lacks resiliency. The packing can be injected through hoses, lines, etc. The packing 45 is packable within the chamber 57. In the preferred embodiment, the specific injectable packing used is a commercially available product from Teadit, sold under the name JamPak or, alternatively, a commercially available product from Utex Industries, sold under the name U-Pak.

The wall 35 surrounding the chamber 37 has one or more openings 57 therethrough. The openings 57 are located between the upper and lower rings 47, 49. In the preferred embodiment, there are three openings 57, spaced 120 degrees apart around the circumference of the chamber 37. Of course, there could be fewer or more openings; there could be only a single opening 57.

A collar 59 is located around the wall. The collar 59 has a circumferential chamber 61 that communicates with the openings 57. A passage 63 extends from the chamber 61 radially outward to a counterbore 65, which counterbore receives a ball 67. The ball 67 is part of a check, or one-way, valve. The collar 59 is mounted to the stuffing box wall 35 so as to rotate freely. This allows the collar 59 and the reservoir 34 to be positioned favorably about the stuffing box. The collar 59 bears on a stop shoulder (not shown) of the stuffing box 33. The shoulder stops downward movement of the collar 59. A locking ring 73 prevents upward movement of the collar 59. The clearances between the collar 59 and the stuffing box wall 35 are small so that packing does not extrude therefrom.

The reservoir 34 includes a reservoir member 69. The reservoir member 69 has a reservoir chamber 75 formed by a wall 77. In the preferred embodiment, the wall 77 is cylindrical. At the lower end of the wall 77 is a base 79. The reservoir chamber 75 is open at the upper end 81; a cap 83 is threaded onto the upper end of the wall 77. The cap 83 has an o-ring seal 85 therein between the cap and the wall. The upper end of the cap 83 has a threaded opening 87 therethrough for receiving a fitting 89.

The lower end of the reservoir chamber 75 has a stop shoulder 91 extending radially inward. Below the stop shoulder 91 is an ante chamber 93 of reduced inside diameter relative to the reservoir chamber 75. Below the ante chamber 93 is an opening 95 through the bottom wall of the chamber. The ante chamber 93 has a passage 97 that extends to the outside of the base 79. The outermost portion of the passage 97 is formed into a valve seat 99.

Figure 3:
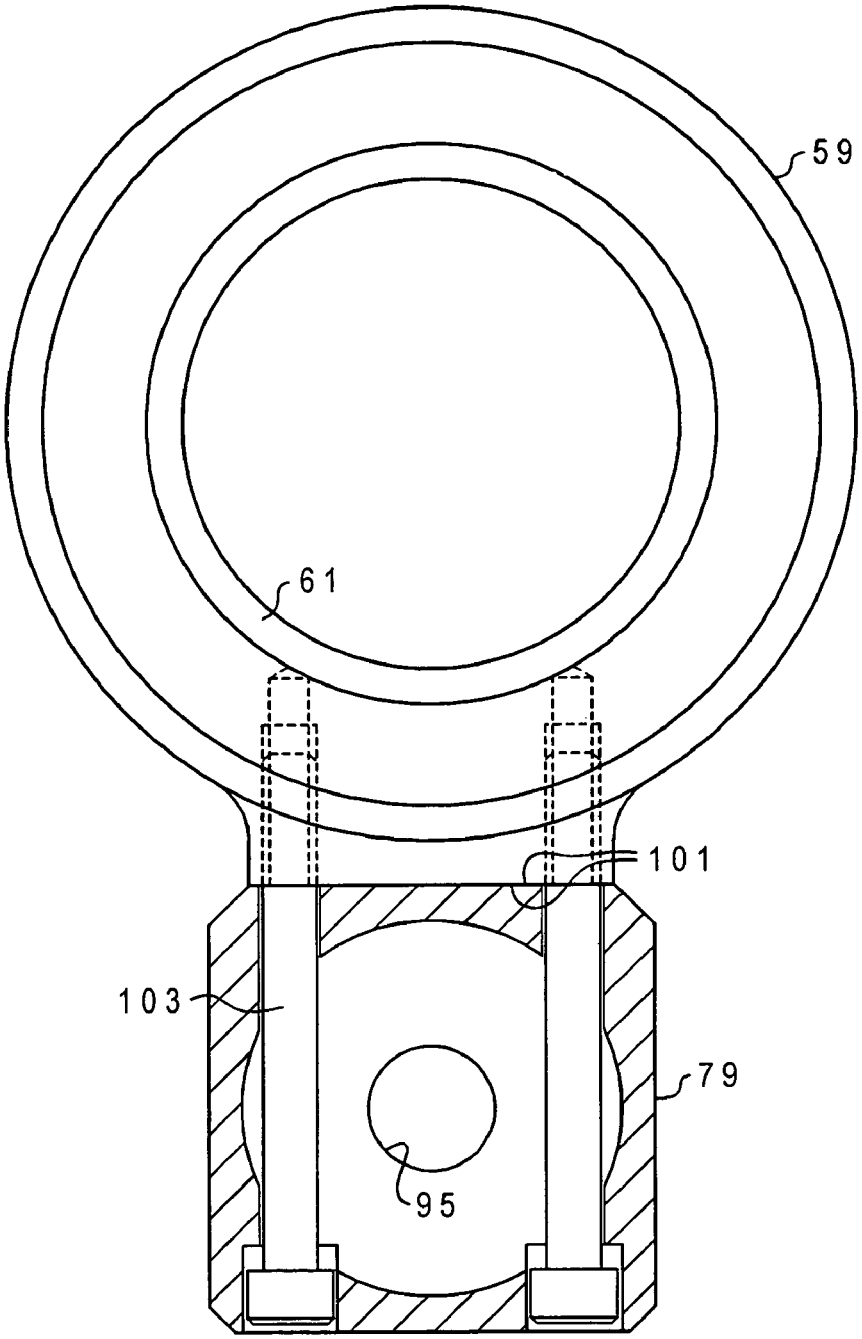
FIG. 3 is a bottom plan view of the collar reservoir member base, taken along lines III-III of FIG. 2.

The reservoir member base 79 is designed to couple to the collar 59. Both the base 79 and the collar 59 have flat surfaces 101 that face each other (see FIG. 3). Bolts 103 secure the base 79 to the collar 59 wherein the base passage 97 is aligned with and communicates with the collar passage 63 (FIG. 2). The ball 67 is located in the counterbore 65 of the stuffing box passage and is designed to seat against the base valve seat 99 to form a one-way, or check, valve.

The reservoir chamber 75 has a piston 105 therein that moves freely up and down inside of the chamber. The piston 105 is fitted to a shaft 107 that extends through the opening 95. The shaft 107 has a passage 109 from its free end to near the piston, where a transverse bore 111 extends through the shaft, intersecting the passage 109. The shaft has a fitting 113 at its free end to couple to a supply of packing material. The passage 109 has a one-way valve 115 therein. The valve 115 fits against a seat 116.

The operation of the stuffing box will now be described. When the stuffing box is installed, packing material 45 is put in the stuffing box chamber 37 around the polished rod 31. Although the packing can be put in through the open end of the chamber 37 (for example, using a putty knife to pack the chamber), it is preferred that the chamber 37 be filled with packing from the openings 57 to purge air from the passages. Packing is injected into the reservoir chamber 75 by an injection gun (not shown), a conventional and commercially available device. The injection gun is coupled to the shaft fitting 113. Once coupled, the gun is operated to inject packing 45 into the shaft passage 109 and into the chambers 75, 93. As packing 45 continues to be injected, the piston 105 will rise in the reservoir chamber 75. The piston 105 will stop against the cap 83, wherein the reservoir chamber is full of packing. Any additional packing will be injected into the passage 97, through the one-way valve 67, 99, into the outer passage 63, the chamber 61 and the openings 57. When all of the chambers and passages are full, the ring 47, bushing 48 and cap 53 are installed. The injection gun is removed from the fitting 113. The one-way 115 valve prevents packing from exiting the reservoir chamber through the fitting 113. In FIG. 2, packing is not shown in passages, channels and openings 57, 61, 63, 65, 97, 109 and 111 for clarity.

The reservoir chamber 75 is coupled to a pressure source to force the piston down and expel the packing material. The collar 59 allows the reservoir 34 to pivot about the stuffing box to avoid obstacles. In the preferred embodiment, the pressure source can be any pressure source located at the wellhead. For example, a line 117 can be extended from the fitting 89 in the cap 83 to a pressurized location on the wellhead, such as a tap off of a pressure gauge, flow line 119, etc. Thus, fluid pressure (whether from liquid or gas) from the well can be applied to the piston. A diaphragm can be used to isolate well fluids from the reservoir. Other sources of pressure can be used, such as an air pump, chemical pump, gravity fed weights, etc. Alternatively, a spring 121 (shown in dashed lines in FIG. 2) can be located inside of the reservoir chamber 75 between the cap 83 and the piston 105 to force the piston in a direction that will expel the packing material. A spring-energized device can be located exteriorly of the reservoir to apply pressure to the piston 105.

During operation, the polished rod 31 reciprocates up and down through the stuffing box. Well fluids 151 (hydrocarbons such as crude oil and gas) are located in the well just below the stuffing box 33, and contact the lower anti-extrusion ring 49 and the lower bushing 50. Eventually, the quantity of the packing 45 in the chamber 37 will diminish due to the operation of the polished rod. However, with the present invention, the supply of packing material in the stuffing box is maintained by the reservoir. The piston 105 injects the packing 45 into the collar 59 and into the stuffing box 33. The check valve 67, 99 prevents packing from reentering the reservoir chamber 75. Thus, the stuffing box is always provided with a proper seal around the polished rod 31, so long as the reservoir is maintained with packing material.

The piston shaft 107 provides a visual indication of the amount of packing inside of the reservoir chamber 75. If the reservoir is full, the shaft 107 will be mostly inside of the reservoir. If the reservoir is empty or nearly so, the piston will be extended below the reservoir. An operator can thus visually determine if more packing should be added to the reservoir. The shaft and piston can be configured to operate in an opposite manner, that is, when the shaft is extended, the reservoir is full of packing. Alternatively, the wall 77 can be transparent to allow an operator to see the position of the piston 105.

The operator can add packing to the reservoir while the polished rod 31 continues to reciprocate. In other words, the well pump need not be shut down to maintain the integrity of the stuffing box seal. The operator need not directly access the stuffing box and break the seal. The check valve isolates the pressures developed in the stuffing box from the reservoir.

Note that while the present invention has been described as mounting the reservoir to the stuffing box, this need not be the case. The reservoir can be mounted to equipment other than the stuffing box; it can be mounted to the ground. Furthermore, the use of a collar around a stuffing box is not mandated. The collar provides a convenient arrangement for delivering the packing to different locations of the stuffing box. However, one or more lines or hoses can be coupled to one or more of the openings 57 in the stuffing box.

Furthermore, the reservoir containing the supply of injectable packing material need not be configured as shown. Other arrangements besides a piston and cylinder can be used to force the packing material into the stuffing box.

Polished rods and pump jack units may move side-to-side due to changes in alignment. The polished rod reciprocates along an axis, which axis 123 is typically vertical, or nearly so. The axis may shift or translate laterally, or it may rotate somewhat or move at a combination of translation and rotation.

Such movement by the axis of reciprocation of the polished rod tends to move the polished rod within the stuffing box. With conventional stuffing boxes, this movement can create gaps in the anti-extrusion rings 47, 49 and/or bushings 48, 50. The packing, being somewhat putty-like in consistency, and under pressure, may extrude from the stuffing box through the gap.

The present invention accommodates such axial movement in several ways. First, the packing is injected into the chamber at positions around the circumference. Thus, for the example described above, packing is injected through openings 57, wherein the gap is filled.

In addition, the present invention allows the stuffing box to move laterally and rotationally. The base of the stuffing box has a radially extending flange element 131. The flange element 131 has upper and lower surfaces that bear on upper and lower bearings 133, 135. The stuffing box 33 can thus move in translation as the flange element 131 moves in a generally horizontal manner between the bearings 133, 135. In addition, the stuffing box 33 can pivot about the base 137 which is fixed to the wellhead 139. The base 137 has spherical surfaces 141, 143 that allows the bearing 135 and a cap 145 to pivot about the base 137. This in turn allows the stuffing box 33 to pivot. The self-aligning arrangement is described in PCT/AU00/00176, the disclosure of which is incorporated herein. In addition, other self-aligning supports are discussed in U.S. Pat. Nos. 5,112,140 and 5,590,966, the disclosures of which are incorporated herein by reference. The stuffing box 33 and reservoir 34 move in unison relative to the base 137.

By allowing the stuffing box 33 to align with the polished rod axis 123, the formation of gaps in the anti-extrusion rings 47, 49 and the bushings 48, 50 will be minimized and the packing 45 will be contained within the chamber 37. If the reservoir 34 is properly supplied with packing material 45, then shutting down the pump 21 need only occur for reasons other than the stuffing box 33.

Figure 4:
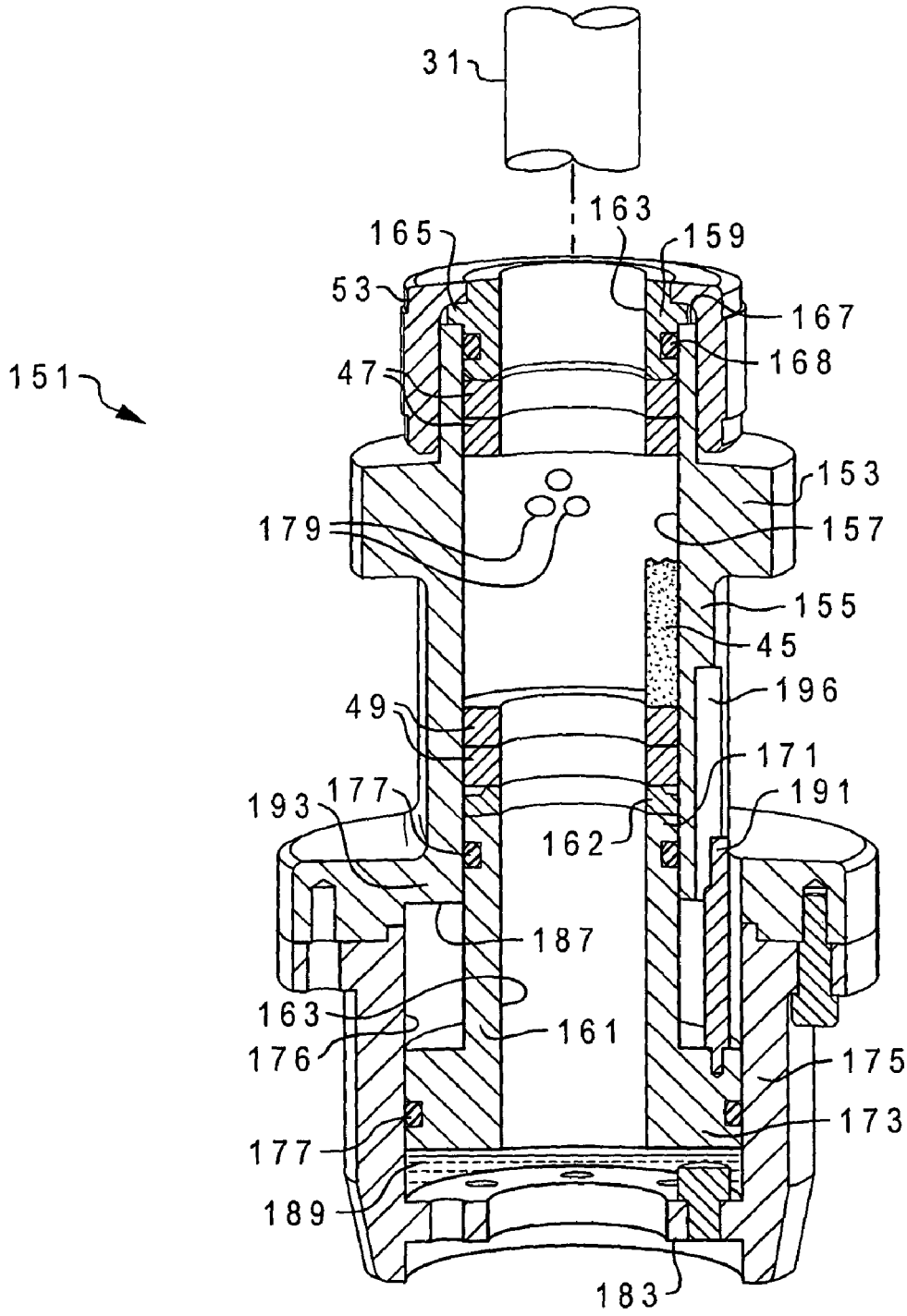
FIG. 4 is a longitudinal cross-sectional view of the stuffing box of the present invention, in accordance with another embodiment.
Figure 4A:
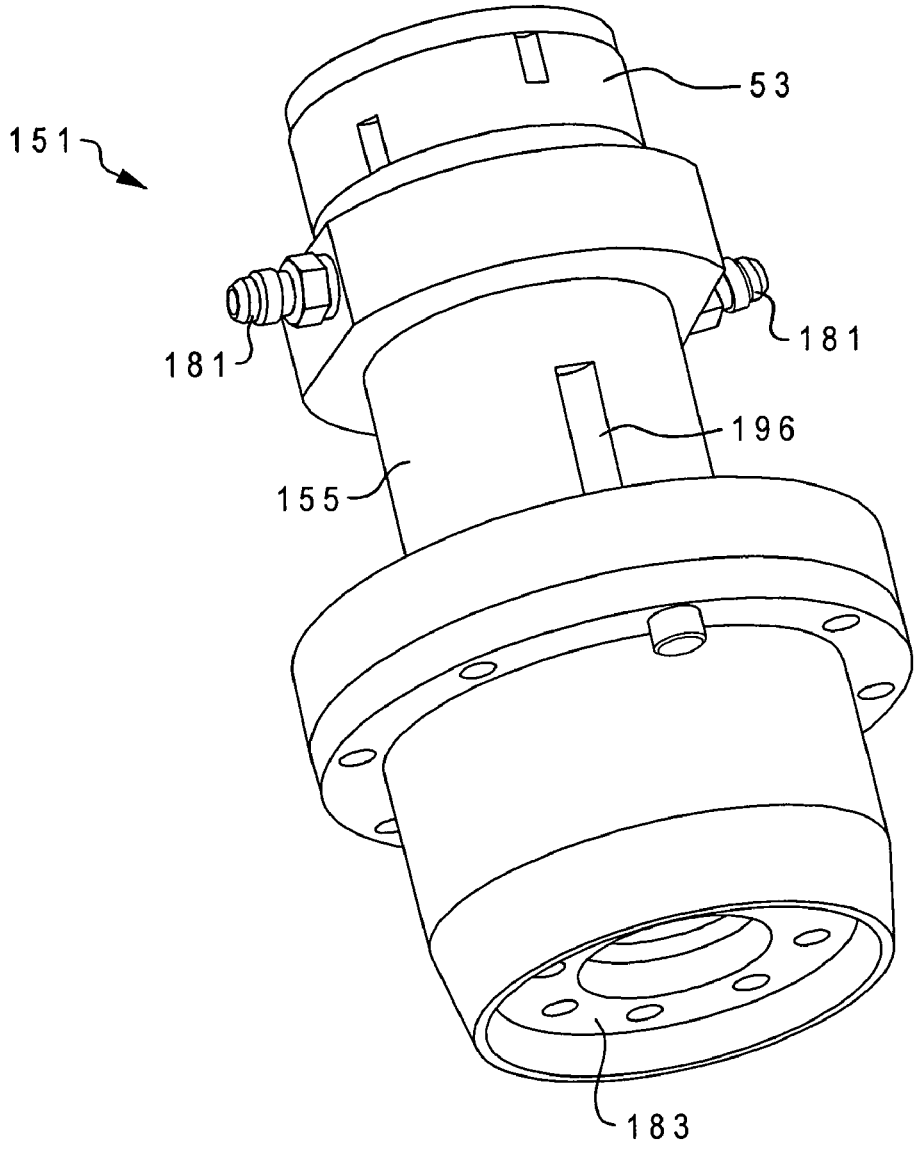
FIG. 4A is an exterior view of the stuffing box of FIG. 4.

In FIGS. 4 and 4A, there is shown the stuffing box 151, in accordance with another embodiment. Instead of utilizing an exterior reservoir for the packing, the stuffing box 151 is self-contained. The packing 45 inside of the stuffing box is maintained in a compacted condition. In FIG. 4, the packing 45 is only partially shown. Furthermore, in FIGS. 4 and 4A, a few exemplary bolts are shown, which bolts are used to couple the various components together.

The stuffing box 151 has a housing 153, which housing has an upper wall 155 that forms a chamber 157 around the polished rod 31. When the polished rod 31 is installed in the chamber 157, an annular region or space is formed around the polished rod. This annular region is filled with the injectable packing 45. The chamber 157 has upper and lower ends, which are closed respectively by the anti-extrusion rings 47, 49 and by upper and lower bushings 159, 161 (preferably of bronze or brass). Both the upper and lower bushings 159, 161 have central openings 163 therethrough for receiving the polished rod 31. In the preferred embodiment, there is provided a pair of upper anti-extrusion rings 47, and a pair of lower anti-extrusion rings 49. A spacer 162 is located between the lower anti-extrusion rings 49 and the lower bushing. The upper bushing 159 and the spacer 162 have ribs that contact the anti-extrusion rings.

The upper bushing 159 extends into the chamber 157 and has a lip 165 for bearing on the upper end 167 of the housing wall 155. A cap 53 threads onto the upper end of the housing wall and clamps the upper bushing 159 in place. The upper bushing 159 is thus fixed in the chamber 157. The cap 53 has a central opening for receiving the polished rod 31. The portion of the upper bushing 159 that extends into the chamber 157 has a circumferential groove that receives an o-ring 168.

The lower bushing 161 is located partially within the chamber 157 so as to telescope within the chamber. In the preferred embodiment shown in FIG. 4, the lower bushing 161 is constructed to obtain a mechanical advantage. The upper end 171 of the lower bushing 161 has a smaller surface area than does the lower end 173. While the inside diameter of the lower bushing 161 is constant along its length, the outside diameter of the upper end 171 is smaller than the outside diameter of the lower end 173. The lower end of the lower bushing forms a flange 173. The lower end 175 of the housing 153 is enlarged to accommodate the flange 173; thus the housing has a lower chamber 176 that has a larger inside diameter than does the chamber 157 with the packing 45. The lower bushing 161 has a circumferential groove at its upper end and another groove at its lower end; the grooves receive respective o-rings 177.

The upper wall 155 of the housing has two fittings 181 (see FIG. 4A) diametrically opposed from one another. Each fitting 181 communicates with openings 179 into the chamber. The fittings 181 each have a one-way, or check, valve. The packing is injected into the chamber through the fittings and openings 179. The number and location of the fittings 181 and openings 179 can vary. The openings 179 are located at the upper end of the chamber 157. Thus, even when the chamber is at its smallest volume, the openings 179 are able to inject packing therein.

The lower end 175 of the housing has a mounting flange 183. The mounting flange 183 allows the housing to be mounted to the wellhead 139 or to other wellhead equipment. For example, the stuffing box housing can be mounted to a self-aligning apparatus 131, 133, 135, 137 and 145 as shown in FIG. 2. The mounting flange 183 would be coupled to an adapter which in turn would be coupled to the flange element 131. The housing need not be mounted to a self-aligning apparatus. Well fluid 189, such as oil and water, can pass through member 185 to contact the flange 173 of the lower bushing 161. All of the embodiments of the stuffing box of the present invention can be used in conjunction with a self-aligning apparatus as well as other apparatuses.

If used with a self-aligning apparatus or other apparatus, the lower bushing 161 need not serve as a bushing. Instead, the other apparatus can provide the bushing. The lower bushing 181 would remain, to compress the packing, as described in more detail below. To prepare the stuffing box for operation, packing 45 is placed in the chamber 157 around the polished rod 31. The packing can be packed inside by removing the cap 53, the upper bushing 159 and the rings 47 and then inserting the packing through the open upper end, as described above. Once the chamber 157 is filled with packing, the ring 47, the upper bushing 159 and the cap 53 are replaced to close the chamber. Alternatively, packing can be injected into the chamber through one or both fittings 181. The injection gun discussed above is coupled to the fitting 181. The packing is forced under pressure into the chamber 157. The lower bushing 161 is pushed down as the chamber 157 fills with packing. The mounting flange 183 serves as a stop to prevent the lower bushing 161 from exiting the chamber 157. Likewise, the lower flange 173 stops the upward movement of the lower bushing all the way into the chamber, due to a stop surface 187 on the housing.

Once the stuffing box 157 has a sufficient charge of packing, the prime mover is started to reciprocate the polished rod 31 and operate the pump down in the well. The well fluid 189, which can be liquid or gas, exerts an upward force on the lower bushing 161, which acts like a piston. The well fluid 189 is pressurized by the downhole pump, or by residual pressure within the well. The piston 161 compacts and pressurizes the packing 45 in the chamber 157, thereby minimizing any voids or spaces in the packing and avoiding any possible leakage paths. By maintaining pressure on the packing 45, the packing is kept packed and in a sealing condition. The amount of force that is applied to the packing 45 is determined by the ratio of the areas of the upper and lower ends 171, 173 of the lower bushing 161. Thus, this force cannot be tampered with by an operator, ensuring adequacy of the seal around the polished rod.

Continued reciprocation of the polished rod will diminish the quantity of packing 45 inside the chamber 157. The stuffing box 151 automatically compensates and adjusts for a reduction in the amount of the packing 45. The lower bushing 161 is pushed up into the chamber 157 by the well fluid pressure, maintaining the packing in a packed and compressed condition.

Referring back to FIG. 4, the lower flange 173 of the lower bushing 161 is equipped with one or more pins 191 that extend upwardly. Each pin 191 is radially offset from the center of the stuffing box so as to extend through an opening in a wall 193 between the upper and lower housing portions, to the exterior of the housing. A groove, or hole, 196 is formed in the outside wall of the housing; the pin 191 moves in the groove. The groove 196 provides protection for the pin. The pin 191 provides a visual indication of the quantity of the packing inside of the chamber. As the lower bushing 161 moves up in the chamber 157, the pin 191 rises on the outside. The operator can thus visually gauge the amount of packing in the stuffing box by looking at how far the pin has moved toward the upper end of the groove 196 or extruded through the hole. The pin can also be colored so that as the pin appears to grow longer, different colors show at its base (for example, green shows first, followed by yellow, and then red). Also, the outside of the housing can be marked or scribed with lines and indications so that the height of the pin can be correlated to the amount of the packing inside the chamber.

Packing 45 is added to the chamber through the fitting 181, as discussed above. The stuffing box 151 need not be opened to add the packing. Thus, the well operator need not be exposed to any potential pressure releases from the well. Furtherstill, the packing can be added while the pump is in operation, while the polished rod 31 reciprocates in the stuffing box 151. The packing 45 can be added through one or both fittings. Packing can be added alternatively or simultaneously to the fittings. As the packing 45 is injected into the chamber, the lower bushing 161 descends, as does the indicator pin 191. The operator fills the chamber 157 with packing, wherein the lower bushing 161 contacts the mounting flange 183. The chamber 157 can be filled with packing when the polished rod is reciprocating, or is not reciprocating.

Utilizing a cylindrical sleeve as a lower bushing, such as shown as 50 in FIG. 2, produces a one-to-one ratio. That is, for every one pound per square inch (psi) of pressure exerted on the lower end by the well fluid, the packing is subjected to one psi on the upper end. With the lower bushing 161 configured as shown in FIG. 4, and described, the lower end 173 has a larger area than does the upper end 171. This is done to achieve an amplification, or hydraulic advantage, and force the lower bushing into the packed chamber 157. The relative sizes of the upper and lower end surfaces can vary in accordance with the size of the polished rod, the pressures developed by the well fluid, and so on. In FIG. 4, the lower bushing shown has a fairly high amplification. That is, a relatively small well fluid pressure will satisfactorily compact the packing 45 without causing binding in the movement of the polished rod. The amplification can be reduced by making the lower end 173 surface smaller. It is believed that amplification ratios ranging from 1:1 to 3.5:1 will operate in a satisfactory manner.

Figure 4B:
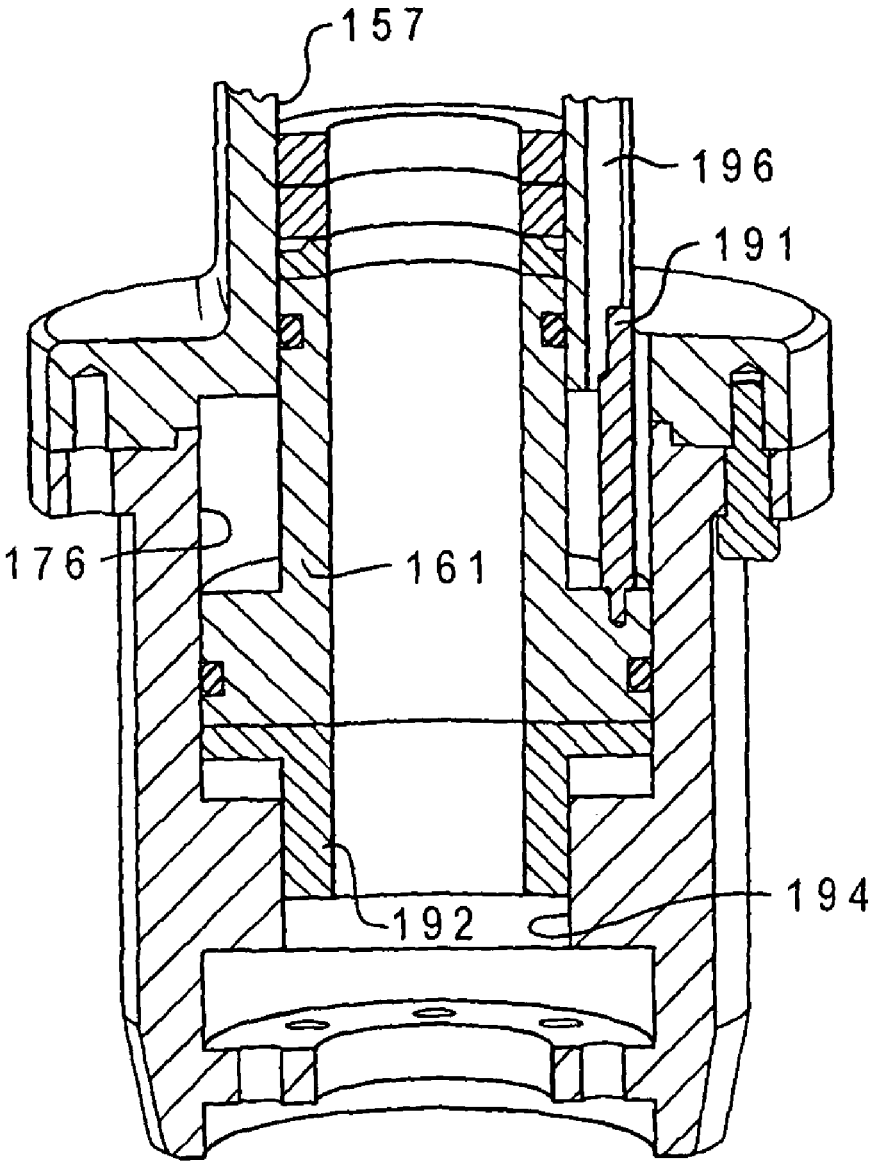
FIG. 4B is a cross-sectional view of the lower end of the stuffing box of FIG. 4, shown in accordance with another embodiment

FIG. 4B shows an embodiment of the stuffing box similar to that of FIG. 4, but modified for a high pressure well. The length of the lower chamber has been increased to accommodate a reducer 192, which is coupled to the bottom of the lower bushing 161. The reducer 192 has a smaller outside diameter than does the lower flange 173 of the lower bushing 161. The housing has a third chamber 194, or throat, that receives the reducer 192. The well fluid contacts the reducer. The reducer is sized so that the higher pressure well fluid forces the lower bushing into the chamber 157 with the desired amount of force. By changing the diameter of the reducer 192 and the third chamber 194, a variety of well pressures can be accommodated. In FIG. 4B, the lowermost o-ring can be placed on the reducer 194.

Figure 5:
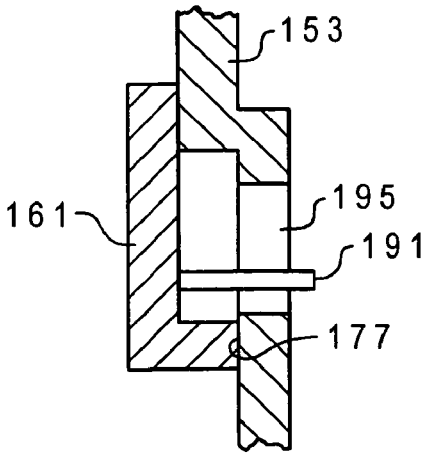
FIG. 5 is a longitudinal cross-sectional detail view of an indicator, in accordance with another embodiment.

If the flange 173 of the lower bushing is sufficiently decreased in outside diameter, the indicator pins 191 may no longer be radially offset enough to extend exteriorly of the housing. FIG. 5 shows an alternate embodiment of an indicator pin 191. The pin is perpendicular to the polished rod longitudinal axis and is coupled to the lower bushing 161. It extends through a slot 195 in the housing. The pin 191 traverses the slot 195 as the lower bushing 161 moves up and down in the housing. O-rings 177 isolate the slot 195 from well fluids and from the packing. The location of the pin 191 in the slot 195 indicates how much packing is in the chamber. The slot can be slightly longer than the distance of travel of the lower bushing, to avoid having a pin serve as a stop.

As an alternative to the embodiment of FIG. 4B, which requires the piston assembly 161, 192 to be sized in diameter according to the well pressure, the piston 161 of FIG. 4 could be used in conjunction with a counteracting hydrostatic pressure. The portion of the lower chamber 176 (see FIG. 4) that is above the flange 173 of the lower bushing, or piston, 161 can contain oil (such as hydraulic fluid). The fluid above the flange 173 thus counteracts the well pressure exerted below the flange. The fluid above the flange can exit the lower chamber via the groove, or hole, 196 and be routed to an accumulator.

In operation, when the stuffing box has sufficient packing, the well pressure pushes the piston 161 into the packing. If the pressure is too high, resulting in too much pressure on the packing, the lower chamber 176 can be filled with fluid. This will lessen the pressure on the packing. As the piston moves up due to the packing volume diminishing from normal use, the fluid exits the lower chamber and flows into the accumulator. When new packing is injected into the stuffing box, the piston is pushed back down and the fluid returns to the lower chamber from the accumulator.

The use of fluid above the piston reduces the number of part sizes, as only one size piston need be made and inventoried for a particular sized polished rod. If the well is subject to variations in well pressure, the use of the fluid damps out these variations. It is possible to regulate the amount of pressure applied to the packing by regulating the hydrostatic pressure or by regulating a gas head exit.

Figure 6:
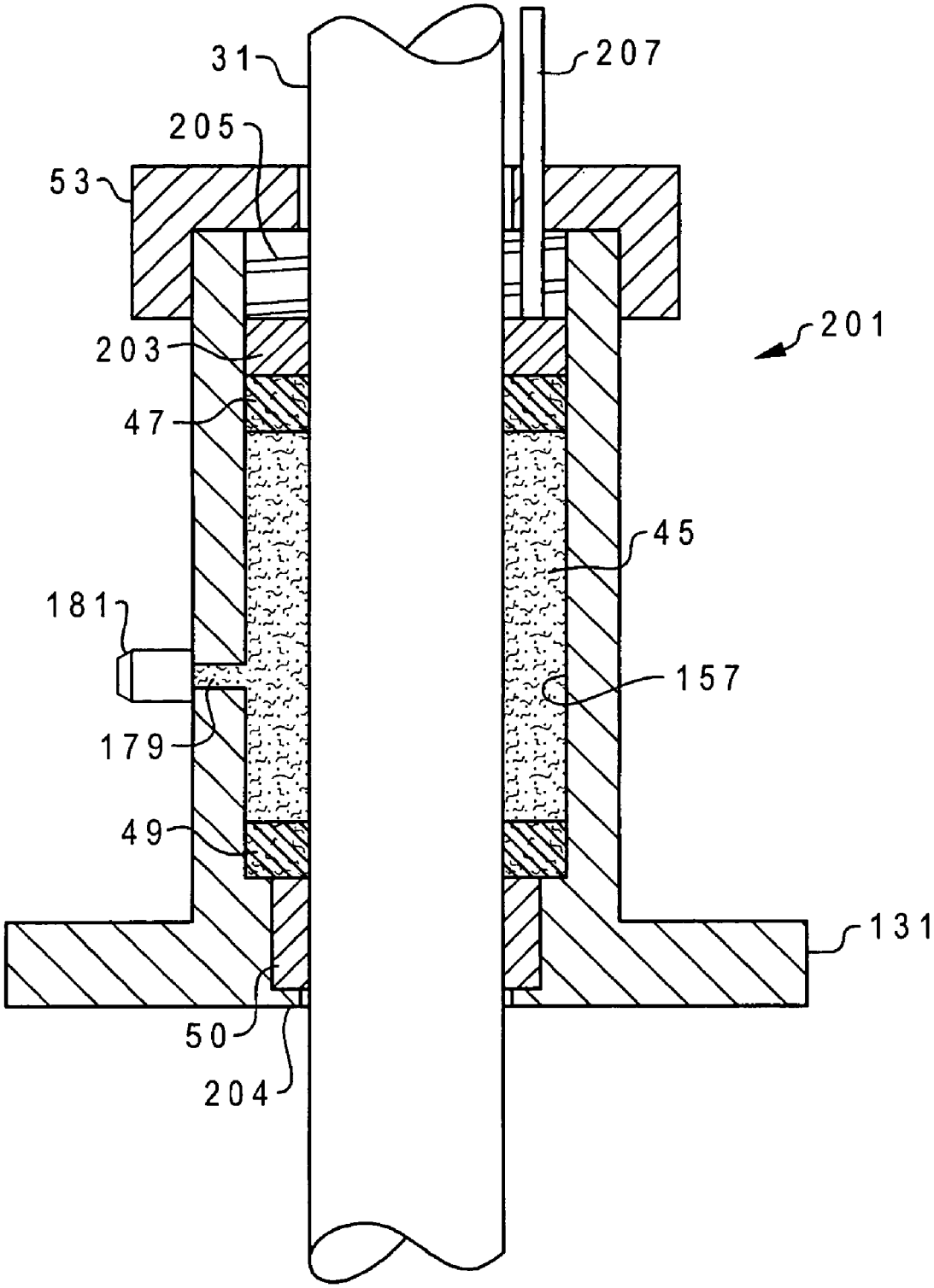
FIG. 6 is a longitudinal cross-sectional view of the stuffing box of the present invention, in accordance with still another embodiment.

FIG. 6 shows a stuffing box 201 in accordance with still another embodiment. The stuffing box 201 is similar to the stuffing box 151 of FIG. 4 in that it is a self-contained stuffing box. However, the source of pressure on the packing is different. Instead of using well fluid pressure acting on the bottom of the packing, the stuffing box uses a force on the upper bushing 203. Thus, the upper bushing 203 is movable within the chamber 157 while the lower bushing 50 is fixed. The upper bushing 203 is a ring; the lower bushing 50 is also a ring or a cylinder but is fixed from moving downward by a lip 204. The upper and lower bushings 203, 50 can be provided with o-ring seals.

The upper bushing 203 is forced down into the chamber 157 by a pressure source. Once such pressure source is a spring 205, located between the upper bushing 203 and the cap 53. Another pressure source is weights.

One or more indicator pins 207 are coupled to the upper bushing 203 and extend up out of the cap 53. As the upper bushing 203 moves down within the chamber, the pin 207 becomes less and less visible.

The chamber 157 is recharged with packing 45 through the fitting 181 as described above, causing the upper bushing 203 and its anti-extrusion ring 47 to rise within the chamber.

As an alternative to the embodiment of FIG. 6, springs can be used on both the upper and lower ends of the packing 45. The upper end remains the same, while the lower bushing 50 would have the same diameter as the upper bushing 203. Springs would push against the housing so as to force the lower bushing into the packing. Alternatively, the lower bushing could be forced into the packing by well fluid, as discussed with respect to FIGS. 4A and 4B.

The stuffing box of the present invention reduces inventory because the same type of packing is used no matter what the type or size of stuffing boxes. In the prior art, packing glands of various sizes (inside diameter and outside diameter) must be stocked in order to accommodate different sizes of polished rods and stuffing boxes. This is not so with the present invention. (Size sensitive anti-extrusion rings will still need to be maintained in inventory.)

The proper amount of force can be predetermined and applied to the stuffing, resulting in a lower coefficient of friction between the seal and the polished rod. In the prior art, some seal ring type stuffing boxes have used a high clamping force on the seal rings. The invention produces consistently lower power requirements.

By continually pressurizing the packing, even when some of the packing has worn away, leakage is eliminated. This means that the well operator need not spend much time monitoring the stuffing box and cleaning up leaks. In addition, once a stuffing box has been on a well for some period of time, its maintenance can be predicted so as to be scheduled to produce operator efficiency.

The stuffing box of the present invention utilizes an injectable packing to provide a seal around the reciprocating polished rod. With prior art stuffing boxes, misalignment of the longitudinal axis of the polished rod may lead to leaks in the stuffing box. But, with the present invention, the packing is conformable to any shift of the polished rod in the chamber. The application of pressure to the packing serves to close any voids in the chamber, thereby minimizing leaks.

The bronze or brass bushings of the stuffing box are sacrificial. Thus, if the polished rod reciprocates off of the center line of the stuffing box, the bushings will wear. Wear on the polished rod will be minimal. The use of sacrificial bushings could lead to misalignment of the polished rod. The self-aligning apparatus of FIG. 2 reorients the stuffing box so as to be aligned with the polished rod, thus reducing the wear on the bushings.

The stuffing box of the present invention can be used without the self-aligning apparatus. However, it is suggested that the stuffing box be equipped with non-sacrificial bushings, such as carbide bushings. The bushings will not wear as much and the packing will continue to be contained within the stuffing box.

The packing can be pressurized, compacted or squeezed by varying the volume of the packed chamber or by injecting additional packing in a fixed volume chamber.

Other visual indicators besides pins 191 could be used. For example, the housing 155 could be transparent, such as plastic. A plastic housing would be suitable for low pressure applications, and possibly even high pressure applications.

The foregoing disclosure and showings made in the drawings are merely illustrative of the principles of this invention and are not to be interpreted in a limiting sense.

The invention claimed is:

1. A method of providing a seal around a polished rod, comprising the steps of:

a) providing the polished rod so that the polished rod is driven at one end in a reciprocating manner and the other end being coupled to a pump located downhole in a well;

b) providing a stuffing box, which stuffing box has a closed chamber having first and second openings therethrough for receiving the polished rod, the chamber having a variable volume;

c) providing packing in the stuffing box chamber, the packing being malleable and injectable;

d) maintaining the packing in the chamber under pressure so that as the amount of packing in the chamber decreases during reciprocation of the polished rod, the chamber decreases in volume.

2. The method of claim 1 further comprising the step of injecting packing into the chamber so as to increase the volume of the chamber.

3. The method of claim 1 wherein the step of maintaining the packing in the chamber under pressure further comprises the step of subjecting the packing in the chamber to the pressure of the fluid produced by the pump.

4. The method of claim 3 wherein the step of subjecting the packing in the chamber to the pressure of the fluid produced by the pump further comprises the steps of selecting a piston having an area that is subjected to the well fluid based on the pressure of the well fluid and providing the piston in the chamber.

5. The method of claim 1 wherein the step of maintaining the packing in the chamber under pressure further comprises the step of subjecting the packing in the chamber to spring pressure.

6. The method of claim 1 further comprising the step of providing an exterior indication of the volume of the chamber.

7. The method of claim 6 further comprising the step of injecting packing into the chamber so as to increase the volume of the chamber.

8. The method of claim 1 further comprising the step of moving an indicating member that is exterior of the chamber in response to the change of volume of the chamber.

9. The method of claim 1 further comprising the step of allowing the chamber to move laterally relative to a longitudinal axis of the polished rod in response to a force that acts on the polished rod so as to move the longitudinal axis of the polished rod.

10. The method of claim 1 further comprising the steps of:

a) providing an exterior indication of the volume of the chamber;

b) injecting packing into the chamber so as to increase the volume of the chamber;

c) the step of maintaining the packing in the chamber under pressure further comprises the step of subjecting the packing in the chamber to the pressure of the fluid produced by the pump.

11. The method of claim 3 wherein the step of subjecting the packing in the chamber to the pressure of the fluid produced by the pump further comprises the step of amplifying the pressure of the pump fluid as applied to the packing in the chamber.

12. The method of claim 1 wherein the polished rod reciprocates along a generally vertical axis, further comprising the step of allowing the chamber to pivot angularly relative to a vertical axis in response to a force acting on the polished rod.

13. A method of sealing a stuffing box on wellhead equipment having a reciprocating polished rod, comprising the steps of:

a) providing the polished rod so that the polished rod is driven at one end in a reciprocating manner and the other end being coupled to a pump located downhole in a well;

b) providing a stuffing box, the stuffing box having a chamber located around a portion of the polished rod;

c) providing a supply of malleable packing inside the chamber;

d) pressurizing the packing in the stuffing box so as to maintain a seal around the polished rod;

providing an indication of the volume of packing in the stuffing box while maintaining the seal around the polished rod.

14. The method of claim 13 wherein the step of providing an indication of the volume of packing in the stuffing box further comprises the step of moving a member that is visible from an exterior of the stuffing box as the volume of packing changes.

15. The method of claim 13 wherein the step of providing an indication of the volume of packing in the stuffing box further comprises the steps of:

a) providing a piston in the chamber, the piston being subjected to well fluid pressure and being moveable within the chamber;

b) providing a member that moves with the piston and is visible from an exterior of the stuffing box as the volume of packing changes.

16. The method of claim 13 further comprising the step of allowing the chamber to move laterally relative to a longitudinal axis of the polished rod in response to a force that acts on the polished rod so as to move the longitudinal axis of the polished rod.

* * * * *